US006003581A

United States Patent [19]

Aihara

[11] Patent Number: 6,003,581

[45] Date of Patent: Dec. 21, 1999

[54] APPARATUS FOR LAMINATING WEBS

[75] Inventor: Kintaro Aihara, Chiba, Japan

[73] Assignee: Nippon Petrochemicals Company, Limited, Tokyo, Japan

[21] Appl. No.: 08/945,896

[22] PCT Filed: Mar. 4, 1997

[86] PCT No.: PCT/JP97/00662

§ 371 Date: Nov. 4, 1997

§ 102(e) Date: Nov. 4, 1997

[87] PCT Pub. No.: WO97/33027

PCT Pub. Date: Sep. 12, 1997

[30] Foreign Application Priority Data

Mar. 4, 1996 [JP] Japan ..... 8-046369

[51] Int. Cl.[6] ..... B30B 15/00

[52] U.S. Cl. ..... 156/555; 156/582

[58] Field of Search ..... 156/324, 555, 156/580, 582, 583.1; 100/327, 160, 176

[56] References Cited

U.S. PATENT DOCUMENTS 5,643,389 7/1997 Kalisiak et al. ..... 156/290
5,653,929 8/1997 Miele et al. ..... 269/173.1
5,783,024 7/1998 Forkert ..... 156/351

FOREIGN PATENT DOCUMENTS 52-119681 3/1976 Japan .
4-267149 8/1992 Japan .
6-24611 2/1994 Japan .

*Primary Examiner*—James Sells
*Attorney, Agent, or Firm*—Scully, Scott, Murphy & & Presser

[57] ABSTRACT

A laminating apparatus (20) for laminating a longitudinal web (19) on a transverse web (28) by maintaining transverse fibrous elements (62) in the transverse direction as much as possible, wherein a skew correction device (39) for correcting the skew of the transverse web in contact with both selvage portions (57, 57) of the transverse web, includes first and second rolls (101, 102) arranged on the side of one selvage portion and the other selvage portion of the transverse web, a common roll (108) arranged on the opposite side of the transverse web with respect to the first and second rolls, and a support means (60) for supporting the first roll, second roll and common roll so as to hold one selvage portion (57) of the transverse web (28) by the first or second roll and an end of the common roll. The travelling speed of at least one selvage portion (57) of the transverse web (28) can be changed.

3 Claims, 5 Drawing Sheets

APPARATUS FOR LAMINATING WEBS

TECHNICAL FIELD

This invention relates to an apparatus for laminating a longitudinal web and a transverse web, in which the longitudinal web is composed of longitudinal fibrous elements that are disposed in almost parallel to the travelling direction and the transverse web is composed of transverse fibrous elements that are disposed in almost transverse direction relative to the travelling direction of the web.

BACKGROUND ART

The laminating machines of the type as referred to above are disclosed, for example, in Japanese Laid-Open Patent Publication Nos. 4-82953 and 4-267149. The attached FIG. 7 is a perspective view showing a conventional laminating machine of this kind. In FIG. 7, a longitudinal web 1 is composed of longitudinal fibrous elements 10 and a transverse web 2 is composed of transverse fibrous elements 9. Furthermore, the transverse web 2 is provided with selvage portions 3. The longitudinal web 1 and the transverse web 2 are fed to a laminating roll 5, on which roll the webs are laminated.

FIG. 8 is a side elevation of the laminating machine as shown in FIG. 7. FIG. 9 and FIG. 10 are partial plan views of the above machine. Before the transverse web 2 reach the laminating roll 5, the transverse fibrous elements 9 are liable to slacken down as shown in FIG. 8, so that the width of the transverse web 2 gets narrow with its slackening as shown in FIG. 9. Therefore, the transverse web 2 must be pulled transversely with a pair of cloth guiders 8 that are disposed at the positions just before the feeding points and the transverse web 2 is then introduced onto the laminating roll 5.

Meanwhile, as shown in FIG. 7, the longitudinal web 1 having a predetermined width is led onto a guide roll 4 in the first place and it is turned back on the guide roll 4 and it is then put in layers with the transverse web 2 that is already fed onto the laminating roll 5. By this arrangement, the transverse web 2 is pressed against the laminating roll 5 by the longitudinal tension in the longitudinal web 1. There is formed an adhesive layer on at least one of the contact surfaces of the longitudinal web 1 and the transverse web 2. These webs are heated during the shifting on the peripheral surface of the laminating roll 5 and the longitudinal web 1 and the transverse web 2 are bonded together on the outlet roll (nip roll) 6 to provide a product (laminate) 7.

Just before the transverse web 2 being laminated with the longitudinal web 1, the transverse fibrous elements 9 of the web 2 must be disposed in the direction perpendicular to the longitudinal travelling direction as shown in FIG. 9. However, the transverse fibrous elements 9 sometimes become oblique (skew condition) as shown in FIG. 10. This is caused to occur due to the unevenness in the properties of both the selvage portions. In other words, because it is not possible to pull forth the transverse fibrous elements 9, both the selvage portions 3 must be pulled forth in order to feed the web onto the laminating roll 5, so that the selvage portions 3 are subjected to considerably large tension.

In this step, when the cross-sectional area or tensile property of one selvage portion 3 differs from those of the other selvage portion 3, the difference in the degrees of elongation of those selvage portions occurs. Even when such a difference is slight, it will be accumulated with the passage of time. Accordingly, the moving of one side edge which is easily elongated is delayed and the arrangement of transverse fibrous elements 9 becomes oblique. When the degree of the skew state of the transverse fibrous elements 9 increases to some extent, the transverse fibrous elements 9 themselves pull the delayed selvage portion, so that the tensile load to the delayed selvage portion is reduced and the selvage portion is elongated no more and it reaches an equilibrium state. Accordingly, the transverse fibrous elements 9 are transferred as they stands in the inclined state.

If the skew state of transverse fibrous elements 9 is caused, it is not possible to produce a desirable product because the fibrous elements 10 of longitudinal web 1 and the transverse fibrous elements 9 cannot be laid perpendicularly. Therefore, it is necessary to avoid strictly the occurrence of skew state of the transverse fibrous elements 9 and, when it is caused to occur, it must be set right. There is a limit to equalize both the selvage portions 3, so that it is not possible to avoid the occurrence of the skew state by means of the equalization of selvage portions. Therefore, in the conventional art, when the skew state is caused, the production lines must be stopped and it must be then restarted. This operation causes a problem in that the productivity is seriously lowered.

It is, therefore, the object of the present invention to solve the above problem by providing an apparatus for laminating web with which the transverse fibrous elements of transverse web is maintained in the possibly correct transverse direction and a transverse web and a longitudinal web can be laminated in a correct relationship.

DISCLOSURE OF INVENTION

The laminating apparatus for webs according to the present invention comprises a laminating roll for laminating a longitudinal web composed of longitudinal fibrous elements arranged almost in parallel to the longitudinal travelling direction and a transverse web composed of selvage portions and transverse fibrous elements arranged in the direction almost perpendicular to their travelling direction, and a skew correction device for correcting the skew of the transverse web by making the device in contact with both the selvage portions of the transverse web which is fed to the laminating roll at a predetermined travelling speed. The skew correction device includes a first roll arranged on a selvage portion of one side of the transverse web and a second roll arranged on the other selvage portion of the other side of the transverse web, a common roll arranged on the opposite side of the transverse web with respect to the first and second rolls, and a support means for supporting the first roll, the second roll and the common roll so as to hold one selvage portion of the transverse web with the first roll and an end portion of the common roll or to hold the other selvage portion of the transverse web with the second roll and the other end portion of the common roll, thereby regulating the travelling speed of at least one selvage portion of the transverse web.

With this mechanism, when the skew of the transverse fibrous elements is caused to occur, the skew condition must be corrected by means of the skew correction device with the measure such that a delayed selvage portion is moved more quickly than an advanced selvage portion and/or the advanced selvage portion is subjected to slight braking action. The above skew correction device is mounted at a position before the cloth guider in the travelling passage of the transverse web.

In a preferred embodiment, a first moving means and a second moving means are provided. The first moving means brings the above first roll close to or apart from the above common roll and the second moving means brings the above second roll close to or apart from the other end portion of the above common roll. With this mechanism, any one of the end portion and the other end portion of the common roll can be brought close to any of the first roll and the second roll and the other end of the common roll is brought apart from the remainder of the first roll and the second roll, thereby supporting the common roll in an inclined position.

In a further preferred embodiment, the first roll and the second roll are driving rolls and the above common roll is a non-driving roll or the first roll and the second roll are non-driving rolls and the common roll is a driving roll. In another embodiment, any one of the pair of the first roll and the second roll and the common roll is braked with a braking mechanism. Furthermore, it is preferable that the first roll and the second roll are disposed on the upper surface of the transverse web and the common roll is disposed on the under surface of the web. An air cylinder is preferably used as the first and second moving means for supporting the rotary shaft of the common roll for moving the shaft vertically. In place of the air cylinder, a hydraulic cylinder, a link mechanism and a cam mechanism can also be used.

When the skew correction is actuated, the selvage portion of the transverse web is supported between the first or second roll and the common roll by bringing the first or second roll close to the common roll by means of the first or second moving means, so that the selvage portion of the transverse web is moved in the same speed as the peripheral speed of the first or second roll. Meanwhile, when the skew correction is not actuated, the transverse web is released from the support with the first or second roll and the common roll by moving the first or second roll apart from the common roll.

BEST MODE FOR CARRYING OUT THE INVENTION

In the following passage, an embodiment of the present invention will be described with reference to drawings.

Figure 1:
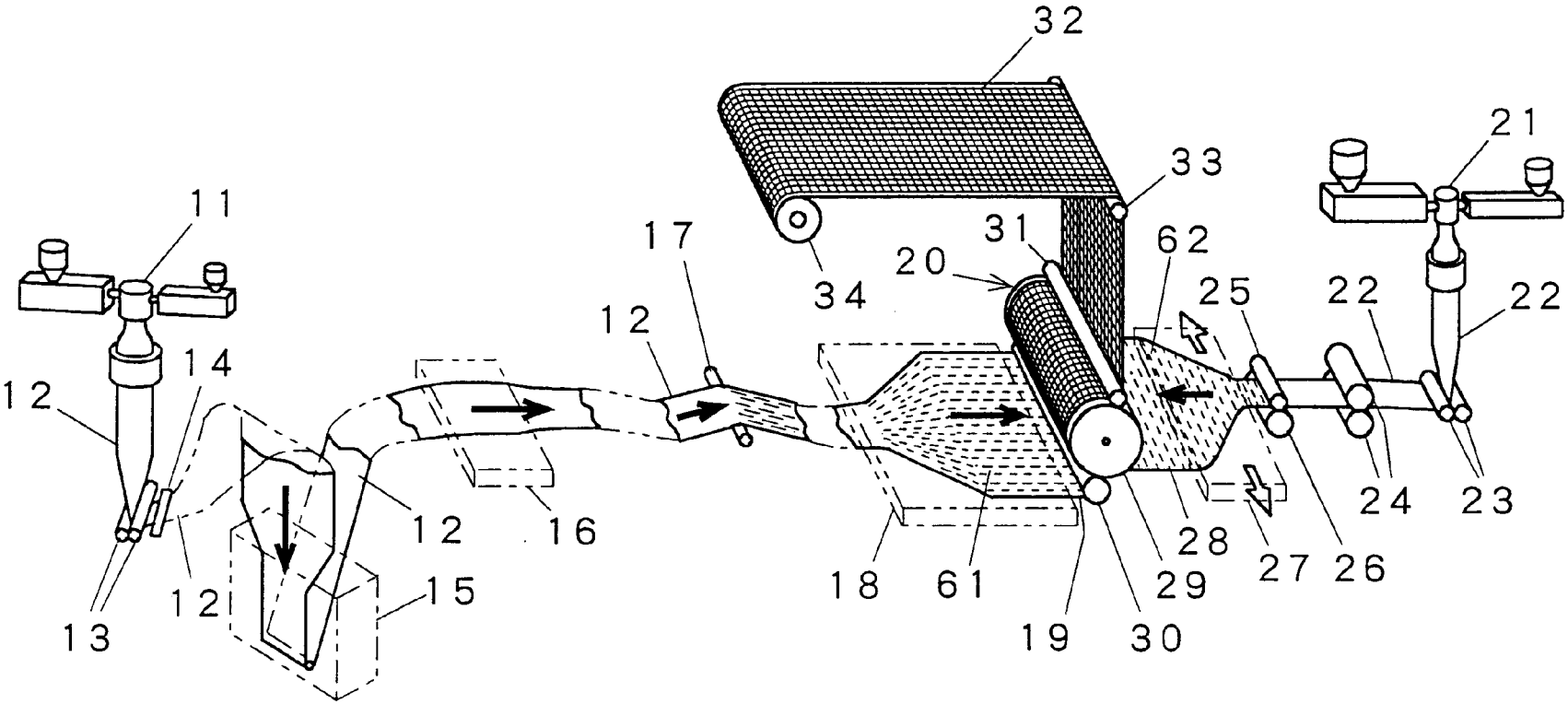
FIG. 1 is a perspective view of the procedure for producing the laminate using an apparatus of the present invention.

FIG. 1 is a perspective view showing the production process using the apparatus according to the present invention. In the drawing, the apparatus 20 for laminating webs is provided on its left side with an extruder 11 to produce a longitudinal web. The extruder 11 is fed with a high density polyethylene and a low density polyethylene, which are extruded as a tubular film 12 from the extruder 11. The extruded tubular film 12 has a triple-layer structure consisting of an outer layer and an inner layer both made of the low density polyethylene and an intermediate layer made of the high density polyethylene.

The tubular film 12 is pinched into folded sheets by a pair of pinch rollers 13 and they are cut open as a wide sheet using a cut-opening machine 14. This wide sheet of the film 12 is stretched at a predetermined ratio in a hot-water bath of a primary stretching device 15. In this stretching operation, the width of the film 12 is reduced according to the stretching ratio. In the next step, it is further stretched at a predetermined ratio in a hot air of a secondary stretching device 16. Also in this stretching operation, the width of the film 12 is reduced likewise according to the stretching ratio.

In the next step, the film 12 is split in the longitudinal direction with a splitting device 17. The film 12 obtained by this slitting process is a reticular sheet having a large number of slits disposed regularly. The split film 12 is then expanded transversely to a predetermined width by a spreading machine 18 to obtain a sheet of longitudinal web 19 mainly composed of longitudinal fibrous elements 61 which are arranged in parallel to the longitudinal travelling direction. The longitudinal web 19 is then subjected to heat treatment (not shown) so as to remove the strain. The material is then introduced into the space between a laminating roll 29 and a feeding roll 30 of a web laminating apparatus 20.

On the right side of the web laminating apparatus 20 is provided an extruder 21 for producing a transverse web. The extruder 21 is fed with a high density polyethylene and a low density polyethylene, which are extruded as a tubular film 22 from the extruder 21. The extruded tubular film 22 has a double-layer structure consisting of an outer layer made of the low density polyethylene and an inner layer made of the high density polyethylene. The tubular film 22 is then pinched into a sheet by a pair of pinch rollers 23 to form a quadruple-layer film having two inner layers made of the high density polyethylene and two outer layers made of the low density polyethylene.

This film 22 is pressed by a pair of pinch rolls 24. By this process, the inner two layers made of high density polyethylene are bonded to form a triple-layer structure of one inner layer of high density polyethylene and two outer layers of low density polyethylene. This film 22 is then introduced between a slitter 25 and a backing roll 26. By this slitter 25, a large number of slits are formed in the transverse direction of the film 22 except both the edge portions. The arrangement of the slits is generally in a cross-stitch pattern. The film 22 is then transversely stretched with a transversely stretching device 27 to obtain a reticular transverse web 28 having mainly transversely arranged fibrous elements 62 and selvage portions 57 (cf. FIG. 2) at both edge portions, which selvage portions are employed for the transferring of the web. The transverse web 28 is then introduced between the laminating roll 29 and the feeding roll 30 of the web laminating apparatus 20.

When the longitudinal web 19 and the transverse web 28 are introduced between the laminating roll 29 and the feeding roll 30, the transverse web 28 is pressed against the laminating roll 29 by the longitudinal web 19 and a delivery roll 31 presses and bonds both the webs together. Through this process, a laminate 32 composed of cross-wise laminated longitudinal fibrous elements 61 and transverse fibrous elements 62, is formed. By way of a guide roll 33, the laminate 32 is wound up by a winding device 34.

Figure 2:
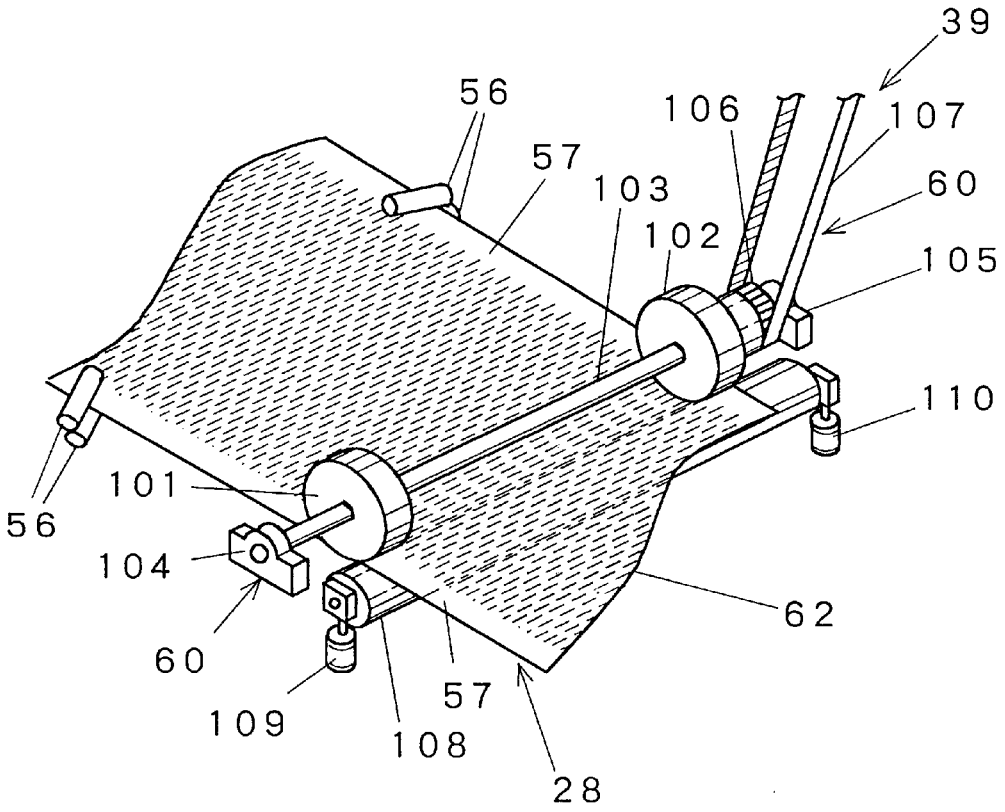
FIG. 2 is a perspective view of an embodiment of the skew correction device used in the present invention.

With reference to FIGS. 2 t 6, the skew correction device 39 for the transverse web 28 will be described. FIG. 2 is a perspective view of the skew correction device used in the present invention. The skew correction device 39 includes a first driving roll 101 which is disposed on the selvage portion 57 on one side of the transverse web 28, a second driving roll 102 which is disposed on the other selvage portion 57 on the other side of the transverse web 28, and a supporting means 60 which supports these rolls and a common roll 108 to maintain the space between these rolls as described below. In this embodiment, the driving rolls 101 and 102 are attached to a common shaft 103, which shaft 103 is rotatably supported by bearings 104 and 105. The shaft 103 is connected to an electric motor (not shown) through a pulley 106 and a belt 107 and it is driven by a common electric motor. Accordingly, one driving device is sufficient.

A long common non-driving roll 108 is disposed under the driving rolls 101 and 102 and the transverse web 28. The left end portion of the common non-driving roll 108 is opposed to the driving roll 101 on the left side and the right end portion of the common non-driving roll 108 is opposed to the driving roll 102 on the right side. Accordingly, both the edge portions of the transverse web 28 can be pinched respectively.

Figure 3:
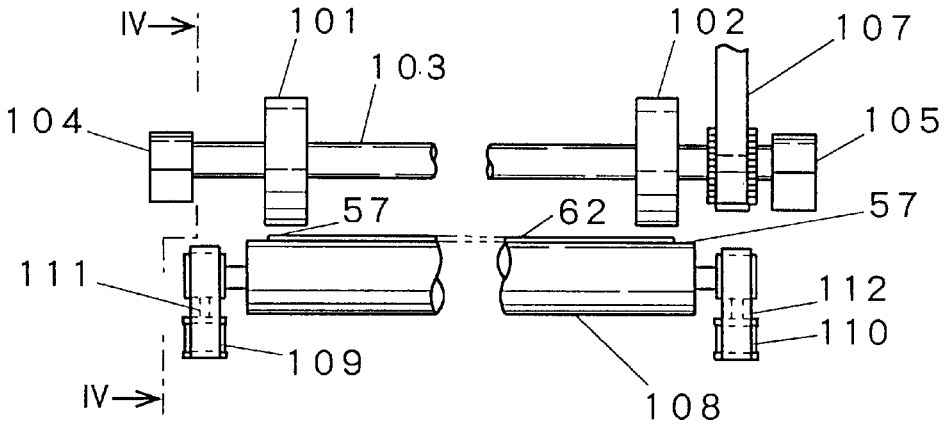
FIG. 3 is a front view of the skew correction device as shown in FIG. 2.

FIG. 3 is a front view of the skew correction device as shown in FIG. 2. In the drawing, the left end portion of the common non-driving roll 108 is supported by the rod 111 of an air cylinder 109 and the right end portion of the common non-driving roll 108 is supported by the rod 112 of an air cylinder 110.

Figure 4:
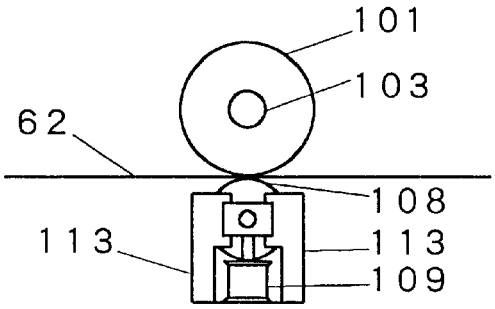
FIG. 4 is a cross-sectional view taken on the line IV—IV in FIG. 3.

FIG. 4 is a cross-sectional view taken on the line IV—IV in FIG. 3. As shown in the drawing, the numeral 113 indicates a supporting frame which slidably supports the rotary shaft of the common non-driving roll 108. Accordingly, the air cylinder 109 can move one end portion of the common non-driving roll 108 close to or apart from the driving roll 101. Likewise, the air cylinder 110 can move the other end portion of the common non-driving roll 108 close to or apart from the driving roll 102.

When the skew correction must be done with one of the air cylinders 109 and 110, the driving roll and the non-driving roll are brought close to each other (in which the non-driving roll is inclined) to pinch a selvage portion 57 of the transverse web 28 by the end portion of the driving roll and the non-driving roll, and the selvage portion 57 of the transverse web 28 is moved at the same speed as the peripheral speed of the driving roll. By this operation, the skew state of the transverse web 28 is corrected (cf. FIGS. 5 and 6).

Figure 5:
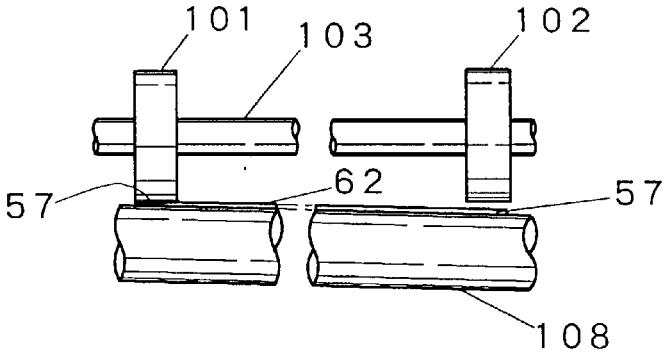
FIG. 5 is a partial front view of the skew correction device in actuation.
Figure 6:
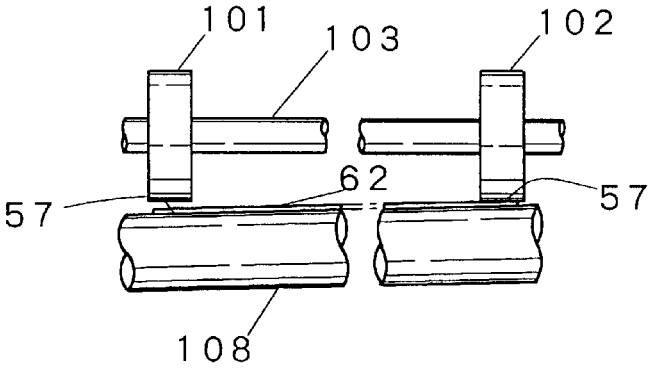
FIG. 6 is a partial front view of the skew correction device in another state of actuation.
Figure 7:
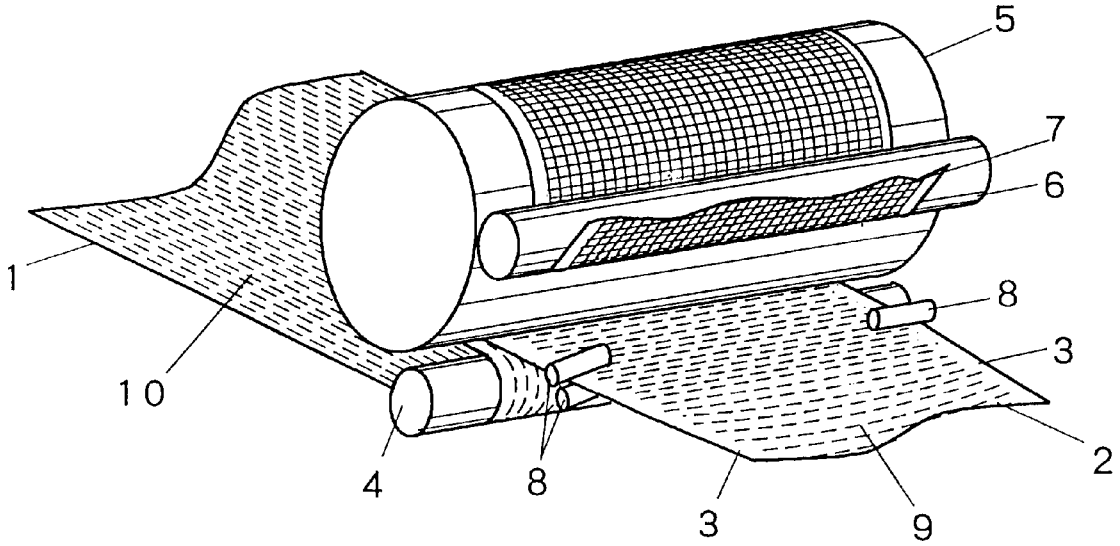
FIG. 7 is a perspective view of a conventional web laminating apparatus.
Figure 8:
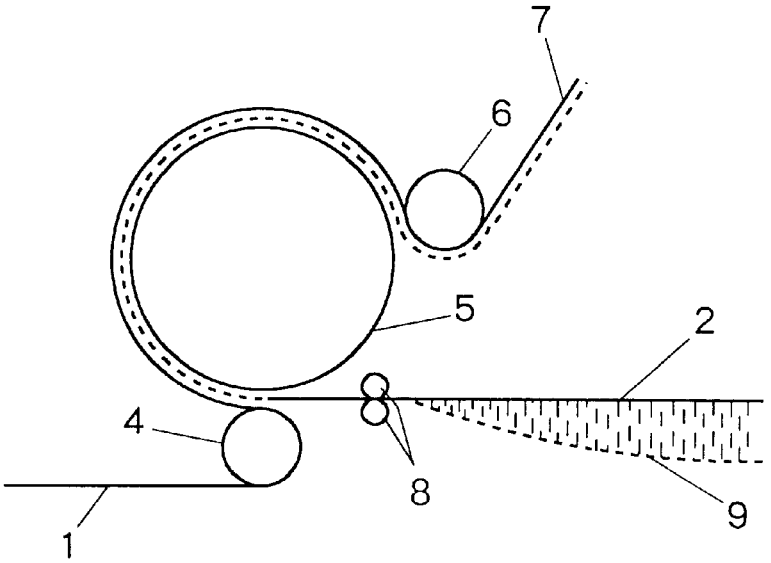
FIG. 8 is a side elevation showing the state of use of the conventional web laminating apparatus as shown in FIG. 7.
Figure 9:
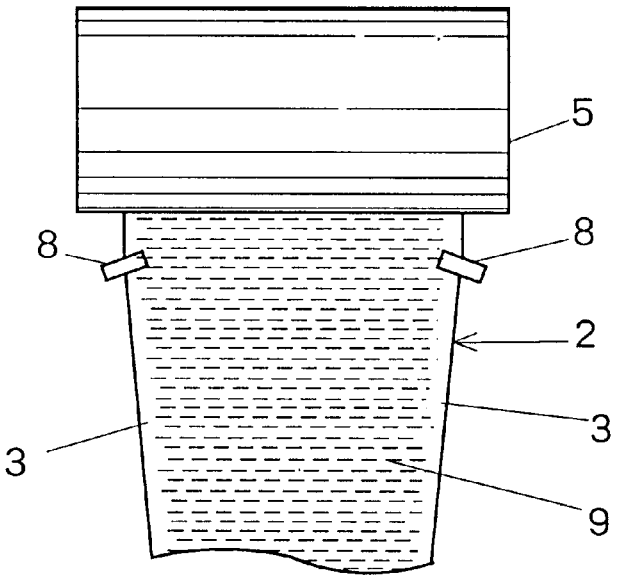
FIG. 9 is a partial plan view showing the state of use of the conventional web laminating apparatus as shown in FIG. 7.
Figure 10:
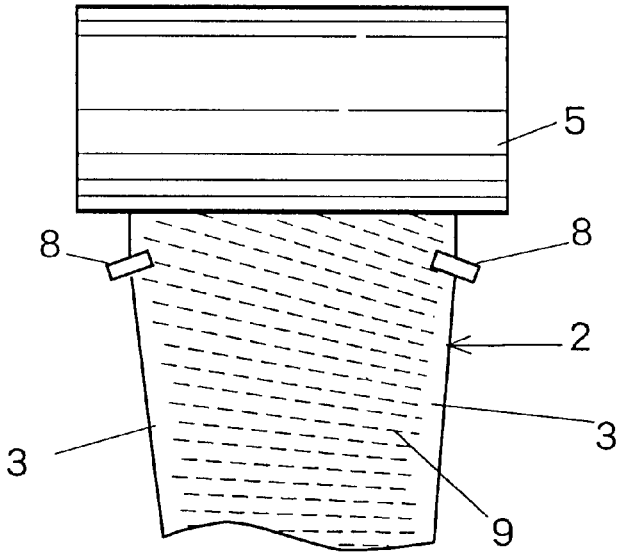
FIG. 10 is a partial plan view showing another state of use of the conventional web laminating apparatus as shown in FIG. 7.

When the skew correction is not done, the related driving roll is moved apart from the end portion of the non-driving roll and the transverse web 28 is released from the pinched state with the driving roll and the non-driving roll. In other words, in the off state of both the air cylinders 109 and 110, the transverse web 28 is not pinched at all as shown in FIGS. 3 and 4. When the air cylinder 109 on the left side is actuated, the selvage portion 57 of the transverse web 28 is pinched as shown in FIG. 5. On the other hand, when the air cylinder 110 on the right side is actuated, the selvage portion 57 of the transverse web 28 is pinched as shown in FIG. 6.

The function of the embodiment of the present invention will be described.

As shown in FIG. 1, after the stretching process, both the selvage portions 57 of the transverse web 28 are pulled by the cloth guider 56 just before the web is fed to the laminating roll 29 (cf. FIG. 2), so that the web 28 becomes the transversely stretched condition. The transverse web 28 is then led by way of the feeding roll 30 and it is pressed to the laminating roll 29 by the longitudinal web 19.

As shown in FIG. 2, the supporting mechanism 60 for the skew correction device 39 that is disposed before the cloth guiders 56 is held at non-actuated position under normal condition. That is, as shown in FIG. 3, the common non-driving roll 108 is held at a position apart from both the driving rolls 101 and 102, so that the selvage portions 57 of the transverse web 28 are free from the pinching action which is brought about by both end portions of the common non-driving roll 108 and the driving rolls 101 and 102.

In the event that an operator find the skew condition of the transverse web 28, the air cylinder 109 (110) of the supporting mechanism corresponding to the delayed selvage portion 57 is actuated, so that the end portion of the common non-driving roll 108 is brought close to the driving roll 101 (102) and the relevant selvage portion 57 of the transverse web 28 is pinched between the common non-driving roll 108 and the opposing driving roll 101 (102) as shown in FIGS. 5 or 6. By regulating the electric motor such that the peripheral speed of the driving roll 101 (102) is made larger than the speed of the delayed selvage portion 57 of the transverse web 28, the delayed selvage portion 57 is accelerated to catch up the faster selvage portion 57. The correction of the skew state of the transverse web 28 can be thus accomplished. Accordingly, it is possible to maintain the transverse fibrous elements 62 of the transverse web 28 in the transverse direction as correctly as possible and to laminate the longitudinal web 19 with the transverse web 28 precisely.

Because the selvage portion 57 of the transverse web 28 is not stretched in the transverse direction, it is thicker than the transverse fibrous elements 62. Accordingly, the transverse fibrous elements 62 is not pinched in the portion between the common non-driving roll 108 and the driving rolls 101 and 102. Therefore, the tangling of fibers does not occur.

In the explanation of the above embodiment, the delayed selvage portion 57 is accelerated. The present invention, however, is not restricted to this embodiment. That is, the air cylinder 109 (110) of the supporting means 60 on an advanced side is so actuated that the selvage portion 57 on the advanced side is pinched by the common non-driving roll 108 and a driving roll 101 (102) and the peripheral speed of the driving roll 101 (102) is made slower than the speed of the advanced selvage portion 57 by controlling an electric motor. In this operation, the advanced selvage portion 57 is decelerated by using the motor and the driving roll 101 (102) as brakes, thereby correcting the skew condition of the transverse fibrous elements.

It is possible to attain the similar function to decelerate the advanced selvage portion by using an appropriate braking device in place of the motor in the above embodiment. In this case, the selvage portions 57 of the transverse web 28 are pinched by upper and lower nipples and the nipples on one side are braked by friction.

Furthermore, the transverse web and the longitudinal web are not restricted to those described in the above embodiment. For example, a transverse web is prepared by forming a film having a triple-layered sandwiched structure of an inner layer made of a stretchable thermoplastic resin (HDPE, PET, PP, etc.) and two outer layers made of an adhesive thermoplastic resin having a melting point which is lower than that of the inner layer resin, forming numerous transverse cuts in cross-stitch pattern in the film except both the selvage portions, and expanding the portion of cross-stitch pattern cuts in the transverse direction.

The longitudinal web is prepared by forming a film having an inner layer made of a stretchable thermoplastic resin (HDPE, PET, PP, etc.) and two outer layers made of an adhesive thermoplastic resin having a melting point which is lower than that of the inner layer resin, and longitudinally slitting the film into tape-yarns, stretching the tape-yarns and arranging the yarns side by side, or longitudinally stretching the above film, longitudinally splitting and expanding the split film to a certain width, or forming numerous intermittent longitudinal slits in the above film, and then longitudinally stretching.

Furthermore, the transverse web may be made by transversely stretching a random nonwoven fabric except its selvage portions so as to increase the fibrous contents oriented in the transverse direction. The longitudinal web is also prepared by longitudinally stretching a random nonwoven fabric so as to increase the fibrous contents oriented in the longitudinal direction.

Still further, it is possible to employ a most common tenter for the transverse stretching of transverse web or it is also possible to employ a simple stretching device of the combination of a pair of pulleys and belts as disclosed in Japanese Patent No. 1138234.

In the above described embodiment, the processes for the preparation of a transverse web and a longitudinal web to the process of lamination are carried out continuously. However, it is possible to prepare a transverse web and a longitudinal web separately and to laminate them subsequently.

INDUSTRIAL APPLICABILITY

As described above, it is possible to laminate transverse fibrous elements, in which the skew is liable to occur, by maintaining the fibrous elements in the transverse direction as correctly as possible according to the present invention. Therefore, stabilization of the quality of products and enhancement of yield can be attained.

Furthermore, the stopping of production line for controlling is not necessary, so that the productivity is very much improved.

I claim:

1. A laminating apparatus (20) for webs which comprises a laminating roll (29) for laminating a longitudinal web (19) composed of longitudinal fibrous elements (61) arranged almost in parallel to the longitudinal traveling direction and a transverse web (28) composed of selvage portions (57, 57) and transverse fibrous elements (62) arranged almost perpendicularly relative to the traveling direction, and a skew correction device (39) for correcting the skew of the transverse web by bringing it in contact with both the selvage portions of the transverse web which web is fed to said laminating roll at a predetermined traveling speed, said skew correction device including a first roll (101) disposed on a selvage portion on one side of the transverse web and a second roll (102) disposed on the other selvage portion on the other side of the transverse web, a common roll (108) disposed on the opposite side of said transverse web with respect to the first and second rolls, and a support means (60) for supporting the first roll (101), the second roll (102) and the common roll (108) so as to hold one selvage portion of the transverse web by the first roll and an end portion of the common roll or to hold the other selvage portion of the transverse web by the second roll and the other end portion of the common roll, thereby changing the traveling speed of at least one selvage portion (57) of the transverse web (28), said support means (60) being provided with a first moving means which brings said second roll (102) and the other end portion of said common roll (108) close to or apart from each other, said first and second rolls (101, 102) being attached to a common shaft (103) and driven by a common driving means, said first and second moving means comprising, respectively, air cylinders (109, 110) which vertically and movably support both the end portions of the rotary shaft of said common roll (108), said first moving means bringing an end portion of said common roll (108) close to or apart from said first roll (101) and said second moving means bringing the other end portion of said common roll (108) close to or apart from said second roll (102), thereby inclining said common roll (108) maintaining one end portion of said common roll (108) close to said first or second roll (101, 102) and maintaining the other end portion of said common roll (108) apart from the other corresponding second or first roll.

2. A laminating apparatus (20) for webs as claimed in claim 1, wherein said skew correction apparatus (39) is disposed at a position before a cloth guider (56) in the travelling passage for the transverse web (28).

3. A laminating apparatus (20) for webs as claimed in claim 1, wherein said first and second rolls (101, 102) are disposed on the upper side of said selvage portions (57, 57) of the transverse web (28) and the common roll (108) is disposed on the lower side of the transverse web.

* * * * *